United States Patent [19]

Davis et al.

[11] 4,228,733

[45] Oct. 21, 1980

[54] PACKAGE STRAPPING DEVICE WITH PALLET SENSING MEANS

[75] Inventors: James P. Davis, Crawfordsville; Robert W. Smith, Darlington, both of Ind.

[73] Assignee: Keystone Consolidated Industries, Inc., Crawfordsville, Ind.

[21] Appl. No.: 34,612

[22] Filed: Apr. 30, 1979

[51] Int. Cl.[3] ..... B65B 13/04

[52] U.S. Cl. ..... 100/4; 100/7; 100/26

[58] Field of Search ..... 100/4, 7, 25, 26

[56] References Cited

U.S. PATENT DOCUMENTS

| | | | |
|---|---|---|---|
| 2,985,098 | 5/1961 | Winkler | 100/25 |
| 3,037,444 | 6/1962 | Scott | 100/25 |
| 3,052,178 | 9/1962 | Hall | 100/25 |
| 3,150,585 | 9/1964 | Sterner | 100/25 |
| 3,150,586 | 9/1964 | Snider | 100/25 |
| 3,213,781 | 10/1965 | Collins | 100/26 |
| 3,279,354 | 10/1966 | Dickens | 100/26 |
| 3,376,807 | 4/1968 | Sterner | 100/26 |
| 3,899,963 | 8/1975 | Tremper | 100/25 |
| 3,949,662 | 4/1976 | Woomer | 100/26 |

*Primary Examiner*—Billy J. Wilhite

*Attorney, Agent, or Firm*—Allegretti, Newitt, Witcoff & McAndrews

[57] ABSTRACT

A package strapping machine for strapping a package to a pallet, which pallet is usually constructed from lumber and is of standard shape or configuration. The pallet comprises generally a supporting platform for the package with longitudinally parallel extending stringers secured to the underside of the supporting platform. The strapping machine is provided with a strapping station where the package is tied to the pallet and is so constructed that a strap is carried beneath the stringers and through a strap ring including an arch around the package if the pallet is facing in one direction, because a pallet position sensing means, such as a ray of light which is provided at one side of the pallet, cannot pass through the solid stringers to a photo-sensitive device located at the other side of the pallet. However, if the pallet is turned 90° so that the voids between the stringers which extend completely through the pallet structure are positioned 90° from aforementioned position, the ray of light at one end then passes through the void and impinges upon a light-sensitive device at the other end of the pallet. The strap then will not be carried underneath the stringers, but instead a lower track portion of the strap ring will be removed so that a strap conveying sword and a cooperating sword strap corner are moved to extended positions to pass the strap directly beneath the platform and carry the strap around the pallet and the package with the strap contacting the underside of the platform and the package thereon rather than the underside of the stringers. After the strapping operation is completed, the sword and sword corner are retracted and the U-shaped lower track portion is moved into the position to carry the strap beneath the stringers when the next strapping operation is manually started assuming that the light sensitive means cannot be activated.

The lower track portion consists of two lower track corners with a horizontal portion connected therebetween, forming a U-shape, the entire lower track assembly being mounted so as to be movable at a 90° angle to the plane of the strap travel. The lower track is preferably moved by a reciprocable compressed air cylinder, as is the sword corner. The sword is preferably moved by a reversable air motor.

The electrical circuitry is such that the strapping mode established at the time the pallet is passing the strapping stations, i.e., the "sword" mode or the "lower track" mode, is the mode which will be locked in for that particular cycle. However, if a pallet is passing through the strapping station with the stringers facing in a direction to intercept the light ray to the light sensitive means, which is usually an electric eye, and the strapping operation is manually initiated, the sword mode operation cannot take place. The operation of the horizontal lower track is controlled by an electric circuit including switches and relays. The sword and the cooperating sword corner are positioned to carry the strap between the stringers beneath the pallet-supporting surface and are also controlled by switches and relays which are energized in response to manual initiation but, as stated, are dependent for operation upon energization of a pallet position sensing means such as a light energized electric eye.

14 Claims, 10 Drawing Figures

PACKAGE STRAPPING DEVICE WITH PALLET SENSING MEANS

BACKGROUND OF THE INVENTION

Heretofore, when packages or articles were to be strapped to the standard type of wooden pallet, it was necessary to have the pallets all pass through the strapping machine in one position, for example, with the stringers of the pallet all facing in a direction so that the strap could be carried beneath the platform and the stringers and through the strap arch prior to tensioning and the strap around the pallet and the package thereon. If the pallet was turned 90° as it was conveyed through the strapping machine, the strap would not be carried around the pallet by passing between the stringers because there was no provision made for such operation. In order to provide for strapping the article to a pallet whether the pallet is fed through the strapping machine with the stringers in one direction or with the stringers turned 90° in another direction, the present invention has been devised to operate the strapping machine so that the strap will either pass under the stringers and around the package if the stringers are facing in one direction, but will operate to place the strap beneath the pallet platform between the stringers and around the package if the stringers are turned in a direction 90° from the first described position.

It is, therefore, an object of the invention to provide a pallet strapping machine and control therefor which cannot operate to pass a strap between the stringers of a pallet unless the pallet is facing in such a direction as it passes the strapping station that operation in a mode to pass the strap between the stringers may occur.

SUMMARY OF THE INVENTION

A strapping machine for strapping packages to pallets of the standard type including a platform and parallel stringers, wherein the machine will tightly strap the pallet and the package together regardless of the position of the pallets and the package when conveyed to and through the strapping machine, and wherein operation to effect passage of the strap between stringers of the pallets is prevented if the pallet is not positioned in such a manner that the strap can pass between said stringers.

DESCRIPTION OF THE PREFERRED EMBODIMENT

Figure 1:
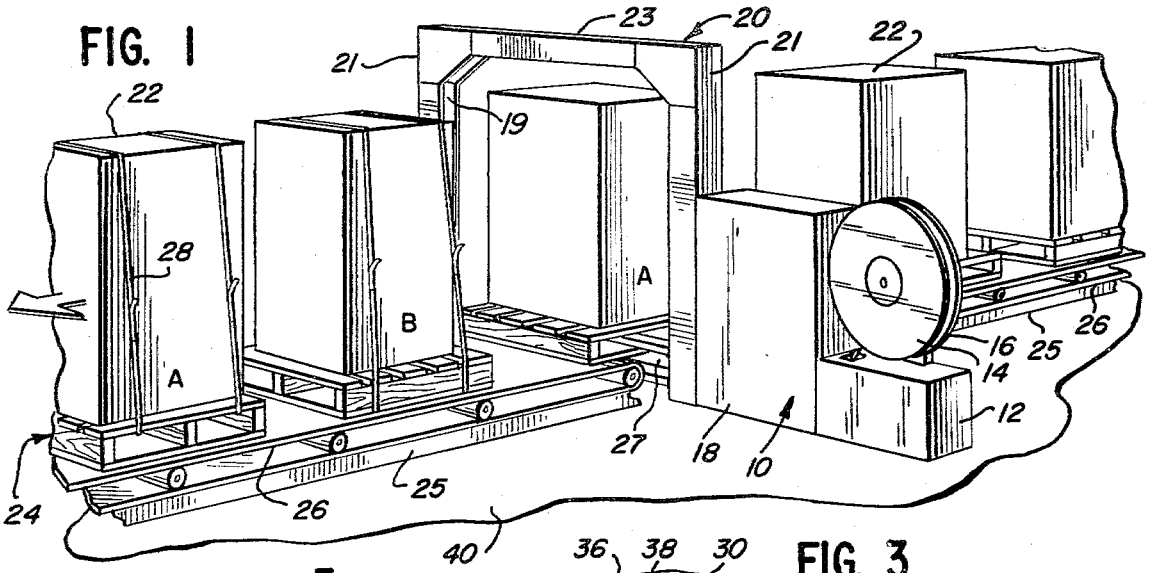
FIG. 1 is a perspective view of a conveyor system and strapping machine for strapping packages or articles to a standard wooden pallet.
Figure 7:
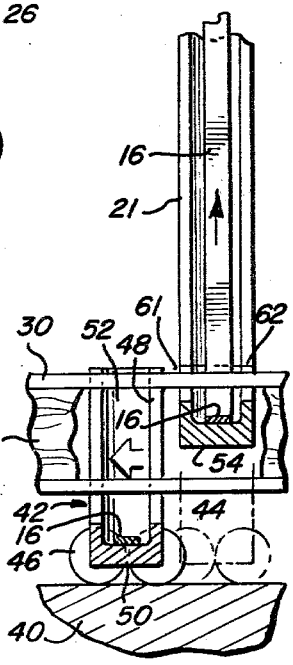
FIG. 7 is a partial sectional view of the lower portion of the machine taken on line 7—7 of FIG. 6.

As shown in FIG. 1, numeral 10 indicates generally a strapping machine which is contained in a casing 18 and has an extension 12 thereon which supports a reel 14 for strap 16, which strap may be formed preferably of suitable plastic material. Since the strapping machine forms no part of the present invention, no further details thereof are shown in the drawings, it being obvious that the strapping machine 10 tightens a strap 28 about a package 22 which is supported on a standard wooden pallet generally indicated at 24. The pallets are moved either facing in an "A" direction or a "B" direction along a path shown by the arrow in FIG. 1 by two conveyor belts 26 having a space 27 therebetween for the application of the strapping material 16 through said space 27 which space constitutes a strapping station. The conveyor belts 26 are provided with supports 25 as shown in FIG. 1 to support them in spaced relation to a floor 40. Numeral 20 indicates an inverted U-shaped arch for containing a track 19 for guiding the strap 16 around the packages 22 and pallets 24. The arch 20 includes side members 21 and a top 23. The bottoms of the side portions 21 of the arch are shown in FIG. 7 at 62 as flat surfaces. The construction and operation of the arch or ring for strapping machines is well-known in the art and is shown, for example, in a co-pending application Ser. No. 935,993 filed Aug. 22, 1978, now abandoned and assigned to Keystone Wire and Steel Company, Inc.

The pallet 24 is of the usual form and is constructed by nailing or otherwise securing support planks 30 to stringers 32. The construction leaves voids 34 between the stringers in one direction. The stringers 32 are generally placed adjacent opposite ends of the planks 30 with an additional stringer 32 spaced therefrom near the center of the pallet, although additional stringers may be provided for larger pallets.

Figure 2:
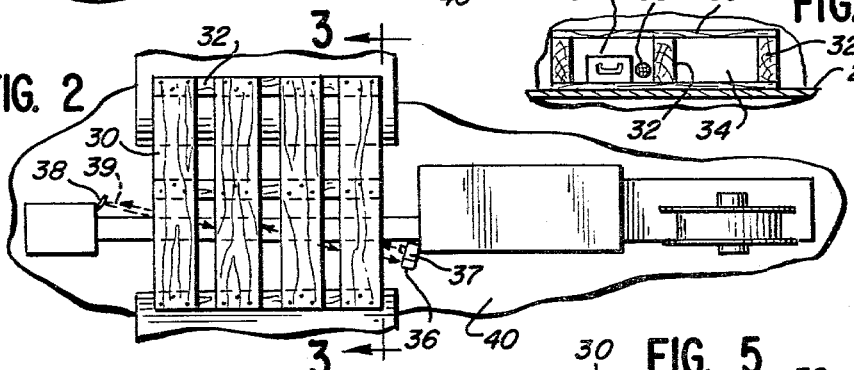
FIG. 2 is a partial top view of the machine shown in FIG. 1.
Figure 3:
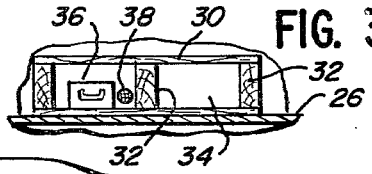
FIG. 3 is a sectional view taken on line 3—3 of FIG. 2.
Figure 4:
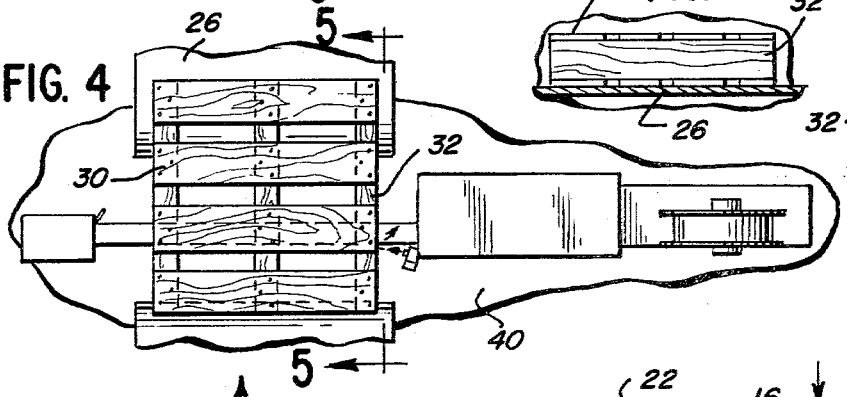
FIG. 4 is a top view of the machine shown in FIG. 1 with the pallet turned 90° from the showing of FIG. 2.
Figure 5:
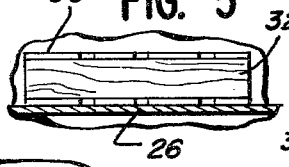
FIG. 5 is a sectional view taken on line 5—5 of FIG. 4.

36 indicates diagrammatically an electric eye and 37 a light source such as an incandescent lamp which directs a beam of light toward a reflector 38, which reflects the beam back to the electric eye, as shown by the arrows in FIG. 2. Therefore, when light is permitted to pass from the light source 37 to the reflector 38 and back to the electric eye 36, the electric eye produces a flow of current in a manner well understood in the art that is used to control the operation of the machine in a manner hereinafter described.

Figure 6:
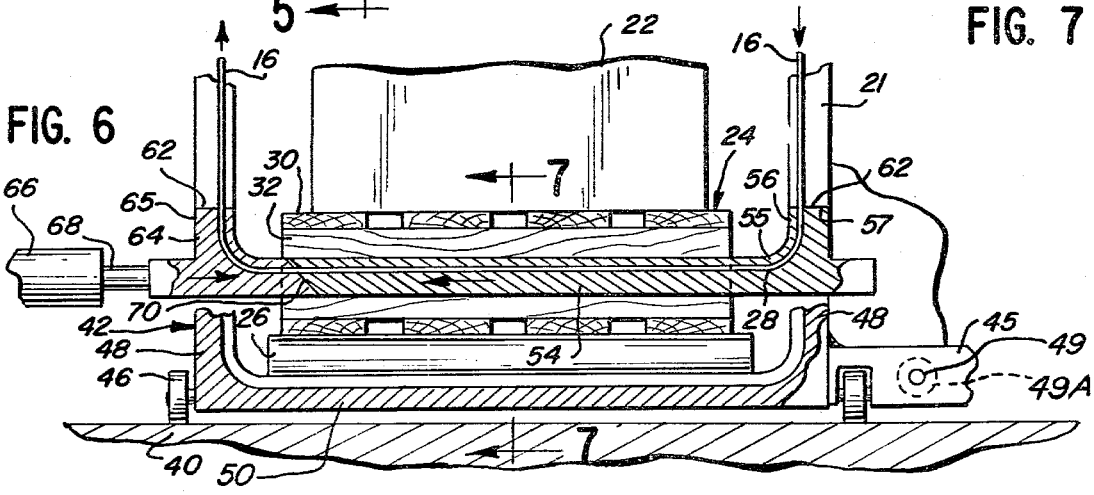
FIG. 6 is a partial vertical sectional view of the upper portion of the strapping machine shown in FIG. 1, with the pallet facing in a direction in which the voids are in one positon relative to the machine.
Figure 9:
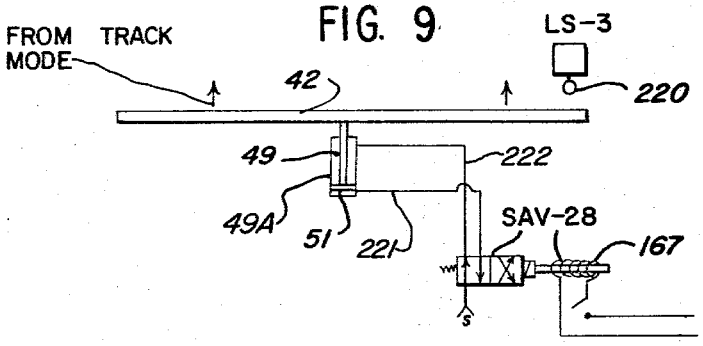
FIG. 9 is a schematic showing of the operating parts and controls for the lower track mode of operation of the machine.

The entire strapping assembly is supported on the floor 40 and the arch 20, which includes an inner channel for the strap 16, includes a generally U-shaped lower track 42, which is also channel shaped for conveying and guiding the strap 16, and which has a flat portion 50 with open curved ends 48 terminating in flat surfaces 61 to engage with the flat lower ends 62 of the sides 21 of arch 20 when in the dotted line position shown in FIG. 7. The lower track 42 is supported on rollers 46 which roll along the floor 40 when it is desired to move the lower track 42 from the full line position as shown in FIG. 7 to the dotted line position as shown in that figure. The lower track 42 is placed in the dotted line position shown in FIG. 7 at the end of each strapping cycle regardless of the mode which has just been used and remains there until a pallet comes through in a position that the sword mode is capable of being operated when the electric eye 36 may be energized. As shown in FIG. 6, an extension 45 is secured to the lower track 42 and is guided by a reciprocating piston rod 49 which is secured at both ends by a suitable supporting structure (not shown). The reciprocating piston rod 49 is secured to the extension 45 and moves the lower track 42 from the solid line position to the dotted line position shown in FIG. 7, or vice versa, and is operated by a reciprocating air-operated cylinder 49*a* having a piston 51 therein (FIG. 9).

The strap 16 is placed underneath the stringers 32 when the lower track 42 is in the dotted line position shown in FIG. 7. When the lower track 42 is moved to the position shown in the full lines of FIG. 7, the sword-operated mode may be utilized. When the lower track 42 is in the full line position shown in FIG. 7, a hollow sword 54 which has a curved end portion 56 attached thereto and which is also hollow as shown at 55, may be moved into the position shown in full lines in FIG. 7 by means of a reversable air-operated motor 58 (FIG. 10) which operates a chain 61 to move member 60 secured to sword 54 and end portion 56 to position beneath the planks 30 of the pallet 24 through void 34, which is positioned as shown when the pallets are placed on the conveyor belt 26 facing in the direction shown as A in FIG. 1 and in FIG. 2. A top flat surface 57 of the curved end portion 56 engages with the bottom flat surface 62 of one of the sides 21 of the arch 20 when in the position shown in FIG. 6. At the opposite side of the pallet, a separate sword corner member 64 is provided and is movable to the position shown in FIG. 6 and contacts the sword 54 at 70. A top surface 65 of the sword corner member 64 engages with flat surface 62 of the other vertical leg 21 of the arch 20. The sword corner member 64 is moved simultaneously with the sword 54 in a manner hereinafter described by operation of a reciprocable pneumatic cylinder 66 operating a piston rod 68 to move the sword corner member 64 into and out of position beneath the pallet.

ELECTRICAL AND PNEUMATIC CIRCUITS

A complete strapping machine, including the electrical pneumatic and mechanical elements thereof are disclosed in U.S. Flanigan et al. U.S. Pat. No. 3,157,109 for Tying Machine, which patent is assigned to the assignee of the present application.

Figure 8:
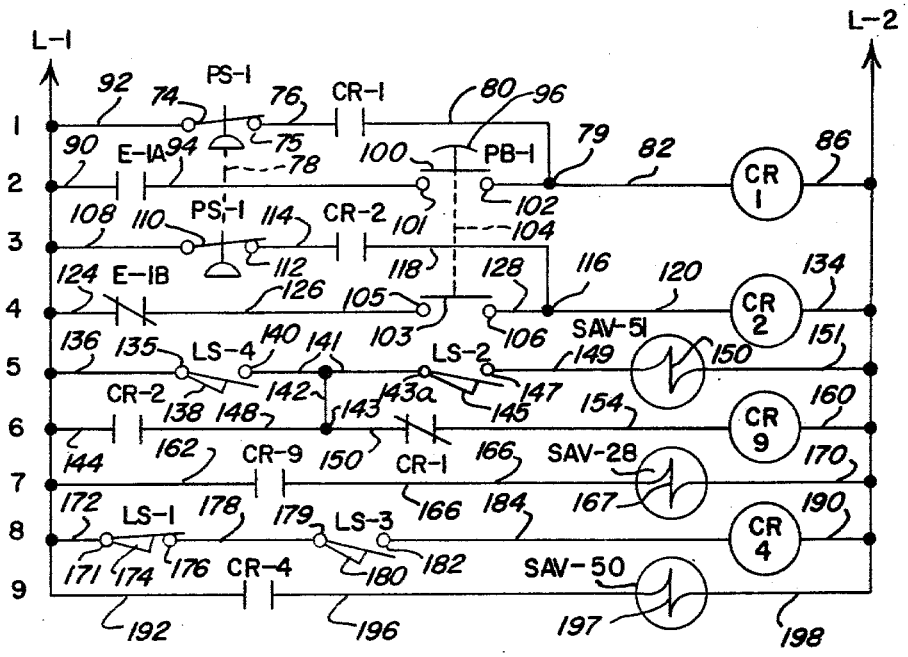
FIG. 8 is an electrical circuit for controlling the two modes of operation of the machine.
Figure 10:
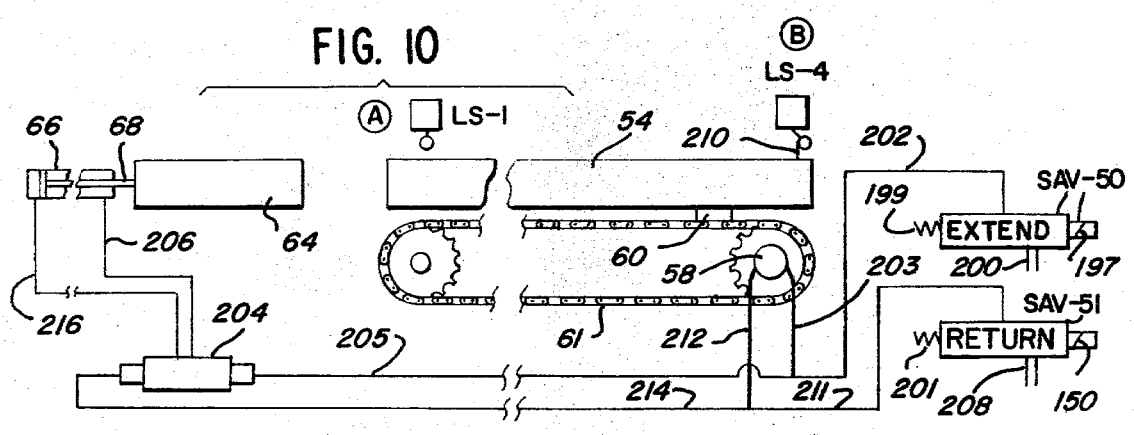
FIG. 10 is a schematic showing of the operating parts and controls for the sword mode of operation of the machine.

Referring now to FIGS. 8, 9 and 10, FIG. 8 is a wiring diagram for operating various relays, switches and solenoids in order to select and control operation of the lower track mode and also of the sword mode of the strapping machine. Lines L-1 and L-2 provide electrical power to the various circuits shown in FIGS. 8, 9 and 10. Some of the LS switches are shown as normally open and some as normally closed. A conductor 92 connects with line L-1 and one movable arm 74 of a pressure operated switch PS-1 which has two movable switch arms 74 and 110 mechanically connected together as diagrammatically shown by the dotted line 78, each arm engaging a pair of contacts. The movable switch arm 74 of PS-1 is shown in engagement with a contact 75 which is connected to one side of contacts CR-1 of a relay CR1 by conductor 76, which contacts CR-1 are shown in a normally open position. The other side of the contacts CR-1 are connected by a conductor 80 to a terminal 79 which is connected to holding relay CR1 by a conductor 82. All the relays denoted by the letters "CR" and a number in a circle are standard relays consisting of a coil, a core and a movable switch arm or armature to open and close contacts upon energization or deenergization of the coil. The contacts operated by each relay and given numbers corresponding thereto; for example, contacts CR-1, are operated by relay CR1.

Terminal 79 is also connected to a contact 102 of a manually operated tie switch PB-1 having a manually operated push button 96 (FIG. 8) for closing the same. Tie switch PB-1 is a four contact switch with two movable switch arms 100 and 103 each engaging a pair of contacts 101, 102 and 105, 106 respectively. Relay coil CR1 is connected to line L-2 by a conductor 86. The switch arms 100 and 103 are mechanically connected together as shown diagrammatically by a dotted line 104.

A conductor 90 connects one side of normally open contacts E-1A which are operated by the electric eye 36. The other side of electric eye switch E-1A is connected to contact 101 of the tie switch PB-1 by a conductor 94.

A conductor 108 connects line L-1 to a movable switch member 110 of pressure operated switch PS-1, which movable member 110 is shown in closed position with respect to contact 112 of switch PS-1. Contact 112 is connected by conductor 114 to one side of normally open contacts CR-2 and the other side of CR-2 is connected by conductor 118 to a terminal 116 which is in turn connected to conductors 120 and 128. Conductor 128 connects with contact 106 of tie button switch PB-1, the switch arm 103 being shown in the open position with respect thereto. Conductor 120 connects terminal 116 to relay CR2. The other side of the relay CR2 is connected to line L-2 through conductor 134.

A conductor 124 is connected to line L-1 and to one normally closed contact of an electric eye switch E-1B. The other side of electric eye switch E-1B is connected by conductor 126 to terminal 105 of switch PB-1.

A conductor 136 connects to a terminal 135 of a limit switch LS-4, which is the sword retract limit switch which has a movable element 138 to engage contact 140. LS-4 is shown in the open position in FIG. 10 because member 210 on movable sword 54 has not been moved to close switch LS-4 at this time. Terminal 140 of limit switch LS-4 is connected by conductors 141 and 142 to a terminal 143, which in turn is connected by conductors 148 and 150 to one side of open contacts CR-2 and to one side of normally closed contacts CR-1. Conductor 141 also connects to terminal 143*a* of switch LS-2, which is a switch opened and closed by any suitable means in the strap sealing cycle of the machine shown in FIG. 1. The switch LS-2 also includes a movable switch member 145 which engages a terminal 147. Terminal 147 of LS-2 is connected by a conductor 149 to coil 150 of valve relay SAV-51 which is in turn connected by conductor 151 to L-2. Valve relay SAV-51 controls return or retract movement of sword 54 and sword corner 64 from beneath the pallet.

Conductor 144 connects to one side of normally open contacts CR-2 and conductor 148 connects the other contacts CR-2 to terminal 143. Conductor 150 connects terminal 143 to one side of normally closed contacts CR-1 which is part of the holding circuit for relays CR1 and CR2. The other contact of CR-1 is connected to relay CR9 by a conductor 154 and the other side of relay CR9 is connected to line L-2 by conductor 160.

Relay CR9 controls operation of the valve SAV-28 for moving the lower track 42, the operating coil for which is shown in FIGS. 8 and 9 at 167. It is noted that valves are electrically operated by all three valve relays SAV-28, SAV-50 and SAV-51 shown in FIGS. 8 and 10 having coils 167, 197 and 150, respectively.

Conductor 162 connects line L-2 with one contact of a normally open contact CR-9 and the other side of CR-9 is connected by conductor 166 to the coil 167 of valve SAV-28. The other side of coil 167 of SAV-28 is connected to line L-2 through conductor 170.

A conductor 172 connects to terminal 171 of limit switch LS-1 which is provided with a movable member 174 shown in closed position with respect to a contact 176. Contact 176 is connected by conductor 178 to a terminal 179 of limit switch LS-3 which is provided with a movable switch member 180 which is shown open with respect to its cooperating contact 182. Contact 182 is connected by a conductor 184 to a relay CR4 which is connected at its other side by conductor 190 to line L-2.

Conductor 192 connects line L-1 to one side of normally open contacts CR-4 and the other contact thereof is connected by conductor 196 to coil 197 of valve SAV-50. The other side of the coil 197 of SAV-50 is connected by a conductor 198 to line L-2.

OPERATION

After the conveyor belts 26 are started in motion, unstrapped packages 22 on pallets 24 are placed on the right hand end of FIG. 1 to be strapped to the pallets as they pass the strapping machine 10. As stated, the pallets 24 may be placed on conveyor belts 26 at random facing either as shown at A or B in FIG. 1.

Assuming that a pallet 24 reaches the strapping station 27 with the stringer 32 in the "A" position shown, the operator pushes the push button 96 to close switch PB-1 to close contacts 101, 102 and 105, 106. As explained hereinafter, lower track 42 is at this time in the dotted line position shown in FIG. 7, having been moved to that position or having remained in that position after the previous package on left hand part of the conveyor belt in FIG. 1 has been strapped.

As previously explained, at this time the light ray 39 can pass through the void between the stringers 32 of the pallet 24 and energize the electric eye 36 to close contacts E1A (FIG. 8).

As shown in FIG. 10, the sword 54 and sword corner 64 are in the retracted position from beneath the pallet 24 because the return valve SAV-51 had been activated by energization of its coil 150 at the end of the previous strapping cycle in a manner hereinafter described. Furthermore, the lower track 42 was moved to the position shown in dotted lines in FIG. 7 beneath the pallet as it would be if the lower track mode was used for the last pallet, and it would remain there until moved by subsequent operation upon closing of the contacts of PB-1 if the electric eye 36 becomes energized.

Since contact E1A now closes, as stated above, upon the electric eye 36 being energized, a circuit is established to operate relay CR1, which is a holding relay, to close contacts CR-1.

When PB-1 is closed, CR2 on line 4 of FIG. 7 is energized, which closes contacts CR-2 on line 6 of FIG. 7, thus energizing relay CR9. CR-9 contact of line 7 closes. This energizes coil 167 of SAV-28 which causes the lower track 42 to move to one side out of the way of the sword 54 and sword end 64. When fully out of the way, limit switch LS-3, (line 8, FIG. 8), is actuated by movement of the track 42.

Limit switch LS-3 and limit switch LS-1 are both closed, thus energizing relay CR4 (line 8 of FIG. 8). Energization of coil 197 of SAV-50 extends the sword 54 and the sword end 64 beneath the pallet between the stringers 32 as explained in the following description of FIG. 10.

Referring to FIGS. 9 and 10, the lower track 42 is shown in the position it assumes when it is in the lower track mode and FIG. 11 likewise shows the sword 54 and the sword end 64 in the lower track mode position, i.e. in their return or retracted positions.

Lower track 42 is moved out of the way, or into the sword mode position by compressed air from source S being conveyed through the proper ports of reversing valve SAV-28 to one side of piston 51 of the cylinder 49*a* to move piston rod 49 which is secured, as stated above, to an extension 45 of track 42 to move the track 42 to the sword mode position in an upward direction as viewed in FIG. 9, and to the full line position shown in FIG. 7, which closes limit switch LS-3. Compressed air is conveyed through a pipe 221 to so move piston 51. When return movement of the lower track 42 is called for, the air flow through valve SAV-28 is reversed by operation of coil 167 to shift its associated armature and prevent flow of compressed air through pipe 222 to force piston 51 in the aforesaid direction and to cause compressed air from source S to pass through pipe 221 to force piston 51 and rod 49 in the opposite direction to re-position the lower track 42 in the lower track mode shown in FIG. 9.

Referring to FIG. 10, the sword mode extend valve SAV-50 with its coil 197 and sword mode retract valve SAV-51 with its coil 150 are shown connected to sources of compressed air 200 and 208 respectively. A reversible air motor 58 is provided for driving a chain 61 over suitable sprockets and a member 60 moved by chain 61 is secured to sword 54 to move the same. A slave valve 204 is also provided for controlling extend and return or retract positions of the sword corner 64 through the operation of an air cylinder 66 reciprocating a piston and rod 68 which are attached to the sword corner 64 as shown in FIG. 6.

When the sword extend coil 197 of valve SAV-50 is energized, at which time coil 150 of valve SAV-51 is deenergized, compressed air is supplied from source 200 through valve SAV-50 and through a pipe 202 and pipe 203 to reversable motor 58 to drive chain 61 in a direction to extend the sword 54 beneath the pallet 24 and between the stringers 32. At the same time, compressed air from pipe 202 is conveyed through pipe 205 through slave valve 204 and through a pipe 216 to move piston and rod 68 of cylinder 66 inwardly to force the sword end 64 beneath the pallet to the sword mode position. A spring 199 returns valve SAV-50 to its closed position when coil 197 is deenergized.

When the return coil 150 of return valve SAV-51 is activated to open that valve, then when valve SAV-50 is closed by spring 199, compressed air is supplied from source 208 through valve SAV-51, through pipe 211 to pipe 212 to the other side of reversible air motor 58 to drive chain 60 to move the sword 54 to the return position shown in FIG. 10. At the same time, compressed air is supplied through pipes 211 and 214 to the other side of the slave valve 204 from the side the pipe 205 is connected, thus causing compressed air to pass through pipe 206 to move piston rod 68 and sword corner 64 in a direction away from sword 54 and from beneath the pallet. A spring 201 forces sword return valve SAV-51 to its closed position when its coil 150 is deenergized.

Movement of the sword 54 opens and closes limit switches LS-1 and LS-4 depending upon the position of the sword by means of a projection 210 (FIG. 10) on the sword 54. Likewise limit switch LS-3 is opened and closed by lower track 42 contacting a projection 220 on switch LS-3. Switch LS-1 is activated at the extended position of the sword 54 to deenergize relay CR4 so that contacts CR-4 (line 9 of FIG. 8) are opened and coil 197 of sword extend valve SAV-50 is deenergized and valve SAV-50 is closed by spring 199.

The strapping cycle is initiated at this time, (the sword mode having been established), by the closure of the limit switch LS-1, limit switch LS-3 being closed at this time by movement of the lower track 42 out of its strap carrying position. The first function of the strap cycle is to feed the strap around the arch 20 where the end of the strap contacts a head switch LS-2 which closes a strap gripper mechanism (not shown), of the strapping machine and starts retracting the sword 54 and sword corner 64 by energizing coil 150 of return valve SAV-51. The operation of the strap contacting a head switch LS-2 to close a gripper is well understood in the art and no detailed description thereof is deemed necessary. However, these elements and functions are fully described in our aforesaid Flanigan et al. U.S. Pat. No. 3,157,109.

When the sword 54 is moved to the final retract position, switch LS-4 is opened to open contacts CR-9 to turn off air operated motor 58. The strap is then tensioned by the strapping machine in a well understood manner until a switch (not shown) is activated which starts the strap sealing cycle. Near the end of the strap sealing cycle, at which time overlapping ends of the strap are sealed together by heat and pressure to secure the strap around the package and the pallet, air pressure builds up in a portion of the machine which is momentarily applied to pressure switch PS-1 in FIG. 6, which opens contacts 75 and 112 and releases the holding circuits which conditions the machine for the next strapping operation.

When the sword 54 and the sword end 64 are fully retracted and switches LS-1 and LS-4 are thereby operated, coil 167 of valve SAV-28 is energized by closing switch LS-4 and the track 42 is moved back to its strapping position beneath the pallets 24.

If it is assumed that the lower track mode is indicated by the electric eye 36 not being activated because blocked by the position of the stringers 32 (position B in FIG. 1), the E-1A contact in line 2 of FIG. 8 will be open but contacts F-1B on line 4 are in the normally closed position and relay CR2 will be energized when the push button 96 is operated. CR-2 contacts on line 3 of FIG. 8 will close to start the strap feed motor (not shown). From this point the remainder of the cycle is the same as in the sword mode except for extending the sword 54 and sword corner 64.

From the foregoing it will be apparent that we have provided for strapping packages to pallets regardless of the positions of the pallet as it passes through the point where the strap is placed around the package and pallet to tie them together, which provides for placing the strap between the stringers of the pallet by a sword mode if the pallet is facing in one direction, but preventing operation of the sword mode and providing for utilization of a lower track mode wherein the strap passes beneath the stringers and the package if the pallet is facing in a direction 90° removed from the first mentioned direction.

Although one preferred embodiment of that invention has been shown and described, it is apparent that various modifications may be made in the form of the invention without departing from the principles disclosed in the foregoing. It is our intention therefore that the accompanying claims be construed as broadly as possible consistent with the prior art.

What is claimed:

1. In a strapping machine for strapping an article to a pallet at a strapping station, said machine including means for guiding the strap around the article and the pallet at the strapping station, said means including an arch having substantially continuous top and downwardly extending connecting side portions, said pallet including horizontal article supporting surfaces and vertical substantially imperforate stringers connected to said supporting surfaces, whereby at least one open ended passage extends in one direction between said stringers when the pallet is placed in one position at the strapping station, but which passage extends at an angle of 90° to the first position when the pallet is placed in another at the strapping station; said means for guiding the strap also including, first strap carrying means, means for moving said first strap carrying means to a position under the supporting surfaces of the pallet through the passage in the pallet and between the stringers if the pallet is in said one position, to permit the article and the pallet to be tied together by said strap at said strapping station, second strap carrying means, and means for moving said second strap carrying means to a position under the stringers beneath said passage in said pallet if the stringers are in said other position to also permit the article and the pallet to be tied together by the strap at said strapping station, means for detecting the position of the stringers of said pallet when it is positioned at said strapping station, said means for moving the first strap carrying means to a position to carry the strap between said stringers of the pallet being actuated when said detecting means determines that it may do so, said means for moving the second strap carrying means to a position to carry said strap beneath the stringers being actuated when said detecting means determines that the strap cannot be passed between the stringers of the pallet.

2. A strapping machine as claimed in claim 1 wherein said first strap carrying means comprises a flat sword portion, a curved end portion attached to the flat sword portion, and a sword corner separate from the flat portion and curved end portion, said means for moving said first strap carrying means including separately actuated mechanisms for moving the sword portion with its attached end portion and said separate corner portion into close relationship to form with the top and said of the arch a continuous path for the strap.

3. A strapping machine as claimed in claim 1 wherein said second strap carrying means comprises a flat portion with corner portions at each end adapted to be moved as a unit to form with the top and side portions of the arch a continuous path for the strap.

4. A strapping machine as claimed in claim 1 wherein said first strap carrying moving means includes means for moving the same parallel to the stringer when the detecting means determines that the stringers are in a position to permit the strap to be passed therebetween.

5. A strapping machine as claimed in claim 1 wherein said second strap carrying moving means includes means for moving the second strap carrying means at a 90° angle to said stringers when the detecting means determines that the stringers are in a position to block the passage of the strap therebetween.

6. A strapping machine as claimed in claim 1 wherein said detecting means includes a light source and an electric eye adapted to be energized when the light source impinges thereupon.

7. A strapping machine as claimed in claim 1 wherein said first strap carrying means comprises a sword portion, a curved end portion attached to the flat portion, a sword corner separate from the sword portion and end corner, said first means for moving said first strap carrying means including separately actuated mechanisms for moving the sword portion with its attached end portion and also said separate corner portion into close relationship to form a continuous path for the strap at the strapping station, said second strap carrying means comprising a flat portion with attached corners at each end thereof adapted to be moved adjacent the downwardly extending arch portions of the ring to provide a continuous path for the strap at the strapping station.

8. A strapping machine as claimed in claim 1 wherein electrical holding circuits are provided for holding the first or second movable strap carrying means in one or the other of the two positions and a manually operated switch for initiating operation of the electrical holding circuits.

9. A strapping machine as claimed in claim 8 wherein automatic switching means determines operation of one or the other of said first or second moving means upon operation of said manually operated switch.

10. A strapping machine as claimed in claim 8 wherein switch means is provided operated by a condition being reached in the strapping machine for momentarily opening said electrical holding circuits.

11. A strapping machine as claimed in claim 1 wherein said first moving means includes an electrical circuit including limit switch means which is contacted by movement of said first strap carrying means to at least partially control movement thereof.

12. A strapping machine as claimed in claim 1 wherein said second moving means includes an electrical circuit including limit switch means which is contacted by movement of said second movable strap carrying means to at least partially control movement thereof.

13. A strapping machine as claimed in claim 1, wherein said first and second moving means include electric circuits including a plurality of limit switches at least some of which are contacted by movement of one or the other of said first and second movable strap carrying means to at least partially control movement thereof.

14. A strapping machine as claimed in claim 6, wherein the energization of the electric eye automatically operates switching means in an electrical circuit to initiate operation of said first strap carrying means to cause the sword and sword corner to be moved to carry the strap between the stringers and to cause said second strap carrying means to move from beneath the pallet and the package so that the strap is carried beneath the stringers.

* * * * *